US012446636B2

(12) United States Patent
Jones

(10) Patent No.: US 12,446,636 B2
(45) Date of Patent: Oct. 21, 2025

(54) KNEE PAD ASSEMBLY

(71) Applicant: Grant B Jones, Vista, CA (US)

(72) Inventor: Grant B Jones, Vista, CA (US)

( * ) Notice: Subject to any disclaimer, the term of this patent is extended or adjusted under 35 U.S.C. 154(b) by 724 days.

(21) Appl. No.: 17/006,531

(22) Filed: Aug. 28, 2020

(65) Prior Publication Data

US 2022/0061417 A1 Mar. 3, 2022

(51) Int. Cl.

| | |
|---|---|
| ***A41D 13/06*** | (2006.01) |
| ***A41D 13/05*** | (2006.01) |
| ***A41D 31/28*** | (2019.01) |

(52) U.S. Cl.

CPC ..... *A41D 13/065* (2013.01); *A41D 13/0543* (2013.01); *A41D 13/0562* (2013.01); *A41D 13/0568* (2013.01); *A41D 31/285* (2019.02); *A41D 2300/32* (2013.01); *A41D 2300/33* (2013.01); *A41D 2600/20* (2013.01)

(58) Field of Classification Search

CPC ..... A41D 13/00; A41D 13/05; A41D 13/06; A41D 13/065; A41D 13/0543; A41D 13/0562; A41D 13/0568; A41D 31/28; A41D 2300/32; A41D 2300/33; A41D 2400/38; A41D 2400/80; A41D 2500/52; A41D 2600/20; A63B 2071/1258; A63B 2071/1266; A63B 2208/0214

USPC ..... 2/22, 24

See application file for complete search history.

(56) References Cited

U.S. PATENT DOCUMENTS

| | | | | |
|---|---|---|---|---|
| 3,259,910 A * | 7/1966 | Daignault | ..... | A63B 71/1225 2/24 |
| 5,581,805 A * | 12/1996 | Rennick | ..... | A41D 13/0156 2/22 |
| 5,611,080 A * | 3/1997 | Skottheim | ..... | A63B 71/1225 2/22 |
| 6,253,376 B1 * | 7/2001 | Ritter | ..... | A41D 13/065 2/24 |
| 7,735,148 B1 * | 6/2010 | Turman | ..... | A41D 13/065 2/22 |
| 7,874,017 B2 * | 1/2011 | Jones | ..... | A41D 13/065 2/24 |

(Continued)

FOREIGN PATENT DOCUMENTS

| | | | | |
|---|---|---|---|---|
| DE | 4422481 A1 * | 1/1996 | ..... | A41D 13/065 |
| DE | 10160416 A1 * | 6/2003 | ..... | A41D 13/065 |
| EP | 1273241 A2 * | 1/2003 | ..... | A41D 13/0568 |

*Primary Examiner* — Khoa D Huynh
*Assistant Examiner* — Giao QT Hoang
(74) *Attorney, Agent, or Firm* — Morland C. Fischer

(57) ABSTRACT

A knee pad assembly to protect the knee of a workman who kneels down while working on a work surface. The knee pad assembly includes a flexible upper knee cushion at which to receive and cover the workman's knee and a rigid lower base that lies on the work surface below the upper knee cushion. The lower base has a continuously curved bottom to rock back and forth on the work surface when the workman shifts his weight while kneeling. The upper knee cushion and the lower base are held one above the other against the knee of the workman by a knee pad strap that is wrapped around the workman's leg. A pair of springs (e.g., flexible carbon fiber sheets having a spring memory) extend across the lower base below the upper knee cushion so as to suspend the workman's knee above the work surface and flex in response to the workman's knee pushing down on the knee cushion.

14 Claims, 13 Drawing Sheets

(56) References Cited

U.S. PATENT DOCUMENTS

| | | | | |
|---|---|---|---|---|
| 2005/0277859 | A1* | 12/2005 | Carlsmith | A61F 5/0125 602/20 |
| 2012/0030850 | A1* | 2/2012 | Wood | A47C 16/02 2/24 |
| 2018/0153233 | A1* | 6/2018 | Paquette | A41D 13/065 |
| 2018/0326290 | A1* | 11/2018 | Rodrick | A41D 13/0153 |

* cited by examiner

KNEE PAD ASSEMBLY

BACKGROUND OF THE INVENTION

1. Field of the Invention

This invention relates to a knee pad assembly to cover and protect the knee and shin of a workman who kneels down for long periods of time while working on a hard work surface. The knee pad assembly includes a relatively soft and compressible upper knee cushion that is strapped over and against the workman's knee and shin and a relatively hard lower base to create an outer shell that rocks back and forth over the work surface when the workman shifts his weight while kneeling.

2. Background Art

Workers who lay tile, install a floor, smooth a poured cement surface, etc. are frequently forced to kneel down on a hard work surface for long periods of time. To minimize the discomfort of kneeling on the hard work surface, the workman usually covers his knees with knee pads. However, the conventional knee pads do little more than keep the workman's knees from directly impacting the work surface. Consequently, the workman's knees are still subjected to pressure and possible injury, particularly when the workman must kneel down for a long period of time during the work day.

What is more, from time to time, the workman will shift his weight and rock back and forth to reach different locations on the work surface. In this case, the conventional knee pads are known to remain stationary as the workman leans forwards and back. That is to say, there is no provision in many conventional knee pads to deflect pressure applied from the hard work surface away from the knee as the workman leans his body from a generally vertical erect position towards a generally horizontal position while kneeling down during the job. Consequently, the majority of the pressure generated by the hard work surface is transmitted through the conventional knee pads and concentrated directly against the workman's knee which has been known to result in pain and/or knee damage over time.

Therefore, what is desirable is an improved knee pad assembly to be worn over the knee and shin while a workman is kneeling down on a hard work surface such that the workman's knee and shin are held above the work surface while absorbing and distributing pressure along the knee and shin to reduce pain and minimize the risk of knee damage.

Reference may be made to my U.S. Pat. No. 7,874,017 issued Jan. 25, 2011 for an example of a flexible knee pad assembly that protects the knee of a worker who kneels while working on a hard work surface.

SUMMARY OF THE INVENTION

In general terms, a knee pad assembly is disclosed to be worn over and against the knee and shin of a workman who is kneeling down on a hard work surface. The knee pad assembly is adapted to absorb and distribute pressure away from the workman's knee to improve comfort and reduce the possibility of knee damage when the workman must kneel down during a long work day. A first embodiment for the knee pad assembly includes a knee pad having a flexible upper knee cushion and a rigid lower base that are attached together one above the other. The upper knee cushion has a knee pocket located at the front thereof within which to receive and cover the workman's knee. A shin receiving depression at the opposite end of the upper knee cushion is configured to receive and cover the workman's shin below his knee. A set of openings are formed in the bottom of the flexible upper knee cushion to create a compression zone at which the upper knee cushion collapses so as to absorb and refocus pressure away from the workman's knee in response to the force generated by his knee pushing down against the upper knee cushion towards the work surface. The lower base of the knee pad has a generally U-shaped cavity running longitudinally therealong within which to receive the upper knee cushion. The rigid lower base establishes an outer protective shell having a continuously curved bottom surface along its longitudinal axis at which the knee pad rocks back and forth over the work surface by which the force is distributed along his knee and shin as the workman shifts his weight while kneeling.

The knee pad of the knee pad assembly is held against the knee and shin of the workman by a knee pad strap that is wrapped around the knee pad and the workman's shin. Opposite ends of the knee pad strap are detachably connected to one another by pieces of (e.g., hook and loop) fastener material attached thereto. The knee pad strap is detachably connected to the knee pad by another piece of fastener material that is attached to the bottom of the lower base.

A second embodiment for a knee pad assembly also includes a knee pad having a flexible upper knee cushion and a rigid lower protective base that are attached one above the other. The knee pad of the knee pad assembly is held against the knee and shin of the workman by a knee pad strap that is similar to the knee pad strap of the first embodiment described above. The lower base of the knee pad has a generally U-shaped cavity running longitudinally therealong in which the upper knee cushion is received. A collapse zone is formed in the front of the flexible upper knee cushion which is compressed against the rigid lower base when the kneeling workman leans forward to prevent his knee from sliding off the front of the knee pad. First and second pairs of shoulders are formed in the lower base of the knee pad at opposite sides thereof. First and second flexible (e.g., carbon fiber) sheets having a spring memory are seated on and attached to respective ones of the first and second pairs of shoulders so as to extend laterally across the front of the lower base below the upper knee cushion. The spring sheets are spaced one in front of the other so as to be able to flex independently of one another. When the kneeling workman leans forward on the work surface, the spring sheets will flex in response to the downward pushing force applied thereto by the workman's knee so as to advantageously distribute the force between the workman's knee and shin.

An optional supplemental shin support may be detachably connected to the knee pad of the knee pad assembly. The supplemental shin support has a flat rolling base with a flexible shin cushion and a piece of (e.g., hook and loop) fastener material attached to the top thereof. A pivot base having a round nose is located at the bottom of the rolling base. A pair of coupling tabs stand upwardly from the top of the rolling base to be removably received within respective coupling slots that are formed in the bottom and at the rear of the lower base of the knee pad by which the supplemental shin support is detachably connected to the knee pad. At the same time, the piece of fastener material at the top of the rolling base of the shin support is moved into mating engagement with a complementary piece of fastener material that is attached to the bottom of the lower base of the knee pad. A shin support strap attached to the bottom of the rolling base of the shin support surrounds the workman's shin to hold the flexible shin cushion over and against the shin. When the kneeling workman rocks back on the work surface, the supplemental shin support will rotate downwardly at the round nose of the pivot base at the bottom of the rolling base towards the work surface so that pressure is deflected away from the workman's knee to the shin cushion of the shin support.

DESCRIPTION OF THE PREFERRED EMBODIMENT

Referring initially to FIGS. 1-13 of the drawings, there is shown a first embodiment for a knee pad assembly 1 of the type to be worn by a workman to prevent discomfort or injury to one or both of his knees while having to kneel down and rock back and forth on a floor, pavement or similar hard work surface for long periods of time while completing a job. Although only a single knee pad assembly 1 is shown and described, it is to be understood that the workman may wear a pair of identical assemblies over both of his knees. As will be disclosed in greater detail hereinafter, the knee pad assembly 1 includes a flexible knee pad 3 and a detachable and reusable knee pad strap 5 that is wrapped around the flexible knee pad 3 by which the knee pad is held over and against a knee and shin of the workman.

Figure 5:
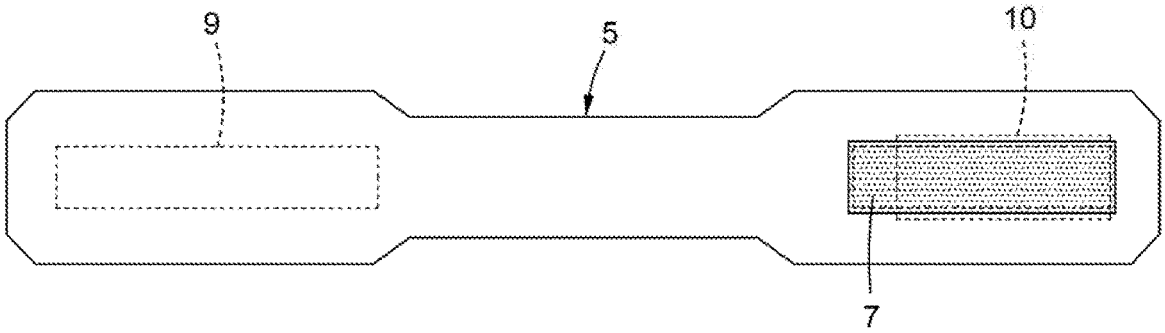
FIG. 5 is a top view of the knee pad strap of the knee pad assembly that is wrapped around the workman's shin to hold the knee pad of the knee pad assembly in place against the workman's knee and shin.
Figure 6:
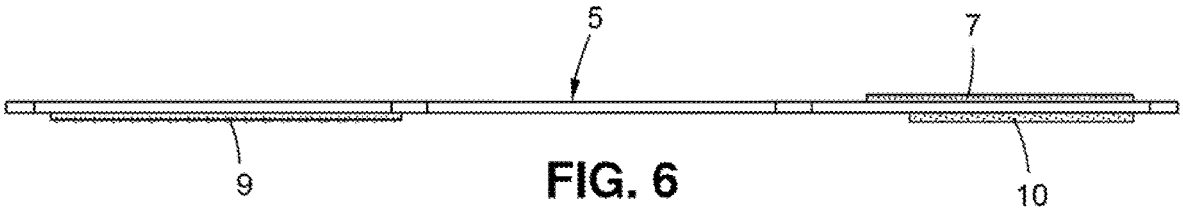
FIG. 6 is a side view of the knee pad strap.
Figure 7:
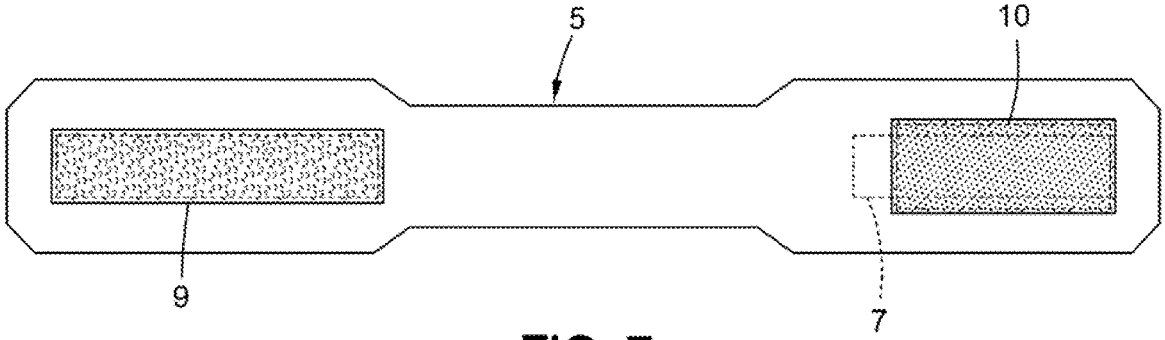
FIG. 7 is a bottom view of the knee pad strap.
Figure 10:
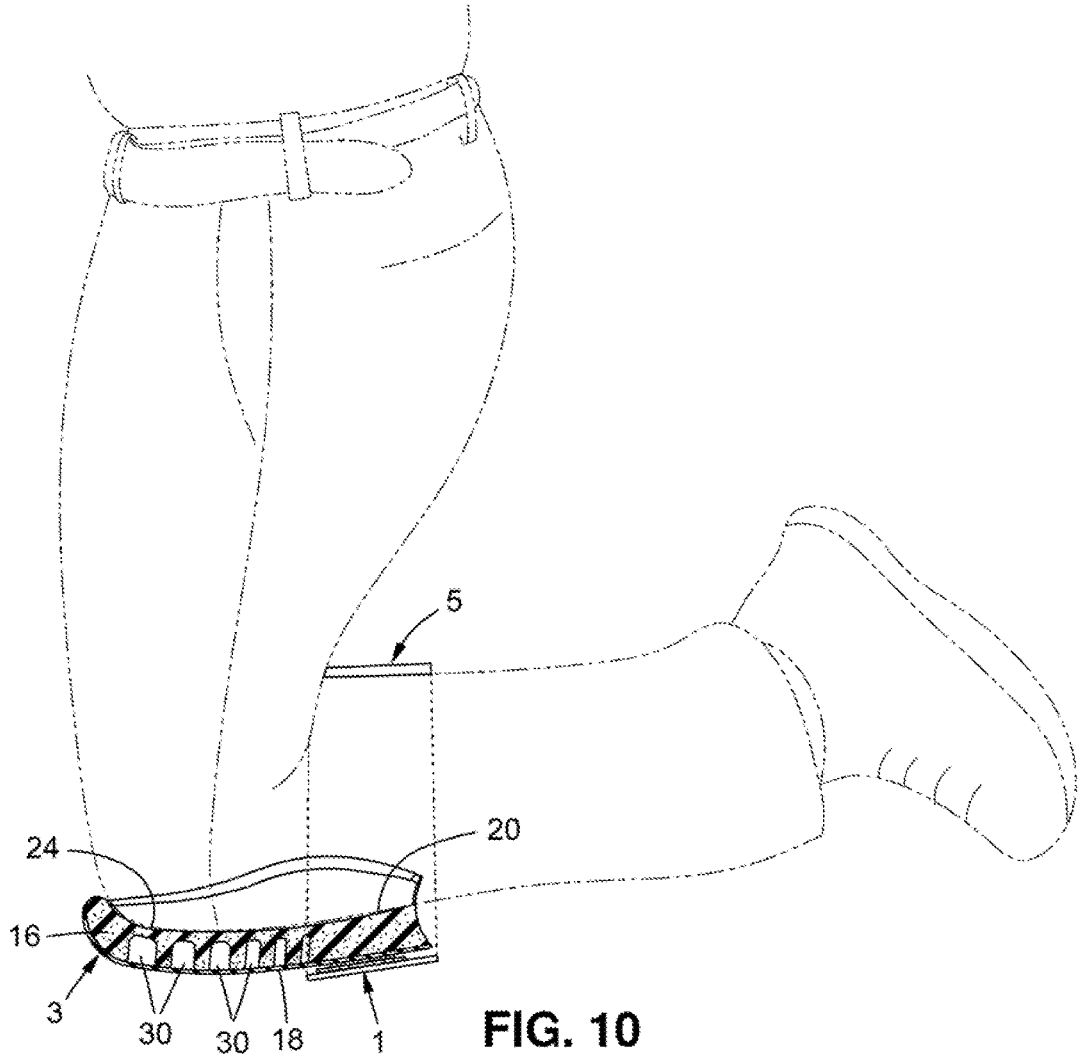
FIG. 10 is a cross-section taken along lines 10-10 of FIG. 4 showing the knee pad of the knee pad assembly held by the knee pad strap against the knee and shin of the workman while he is kneeling on a work surface.

As is best shown in FIGS. 5-7, the knee pad strap 5 of the knee pad assembly 1 includes an elongated strip of soft, flexible material (e.g., cloth or rubber) that is capable of covering the knee pad 3 and being wrapped around the leg of the workman to surround his shin as best shown in FIG. 10. The knee pad strap 5 is universal in its construction, i.e., the same strap can be used to hold a knee pad 3 against either one of the left or right knees of the workman.

Figure 1:
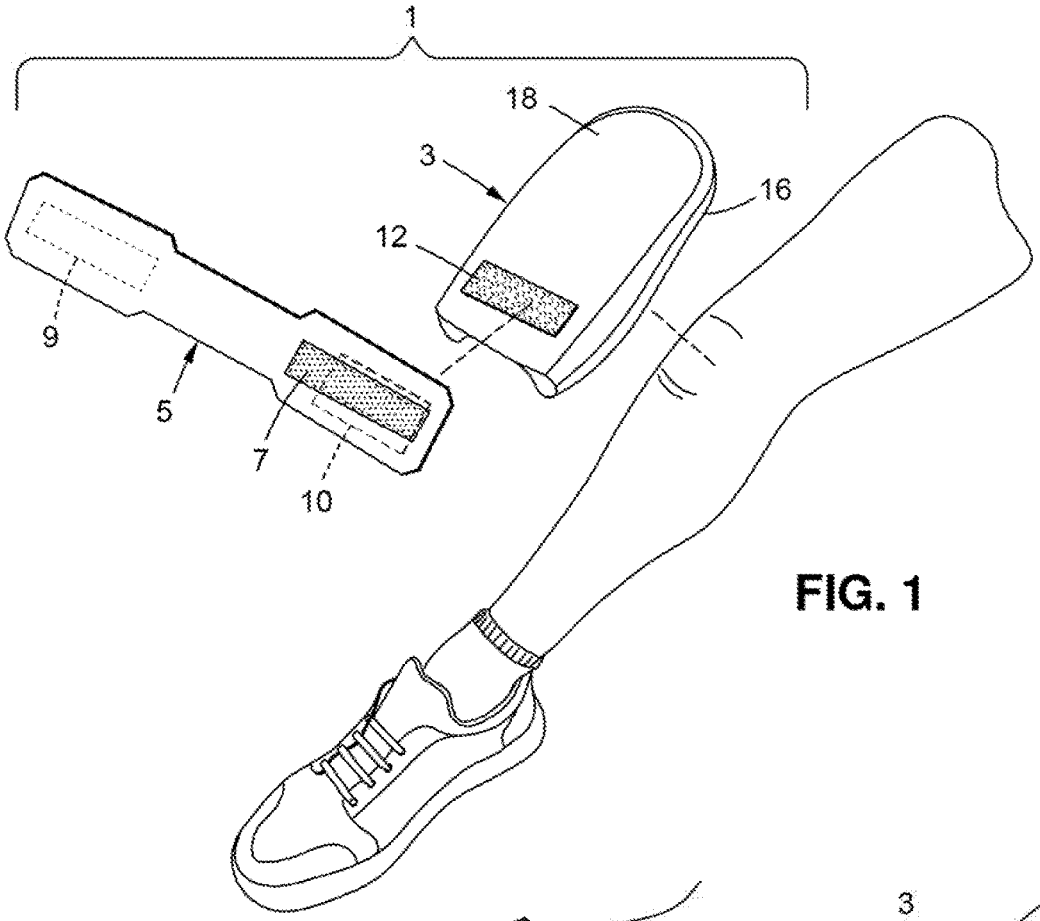
FIG. 1 is an exploded view showing a first embodiment for a knee pad assembly including a knee pad to be held over and against the knee and shin of a workman.

A first piece of hook and loop fastener material 7 (e.g., such as that known as Velcro®) is affixed to the top of the knee pad strap 5 at a first end thereof. A second piece of fastener material 9 is affixed to the bottom of the knee pad strap 5 at the opposite end thereof. A third piece of fastener material 10 is affixed to the bottom of the knee pad strap 5 at the first end thereof so as to lie below the first piece 7. As is best shown in FIG. 1, the knee pad 3 has an outwardly facing fourth piece of fastener material 12 affixed to the bottom thereof.

The use of the knee pad strap 5 to hold the knee pad 3 over and against the knee and shin of a workman in the manner shown at FIG. 10 is now described while referring specifically to FIGS. 1-4. With one hand, the workman positions the knee pad 3 so as to lie over and cover his knee and shin to be protected. With his second hand, he attaches the first end of the knee pad strap 5 to the knee pad 3 by pressing the third piece of fastener material 10 lying at the bottom of strap 5 at the first end thereof into detachable mating engagement with the fourth piece of fastener material 12 lying at the bottom of the knee pad 3.

Figure 2:
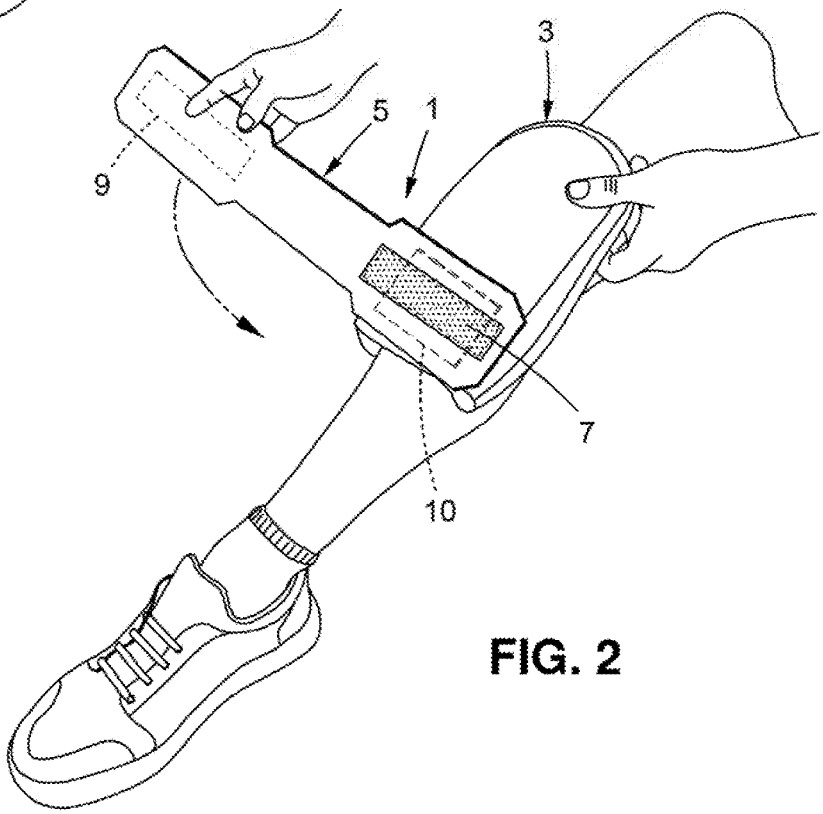
FIGS. 2-4 illustrate the steps by which a knee pad strap of the knee pad assembly of FIG. 1 is used to attach the knee pad to the knee and shin of the workman.
Figure 3:
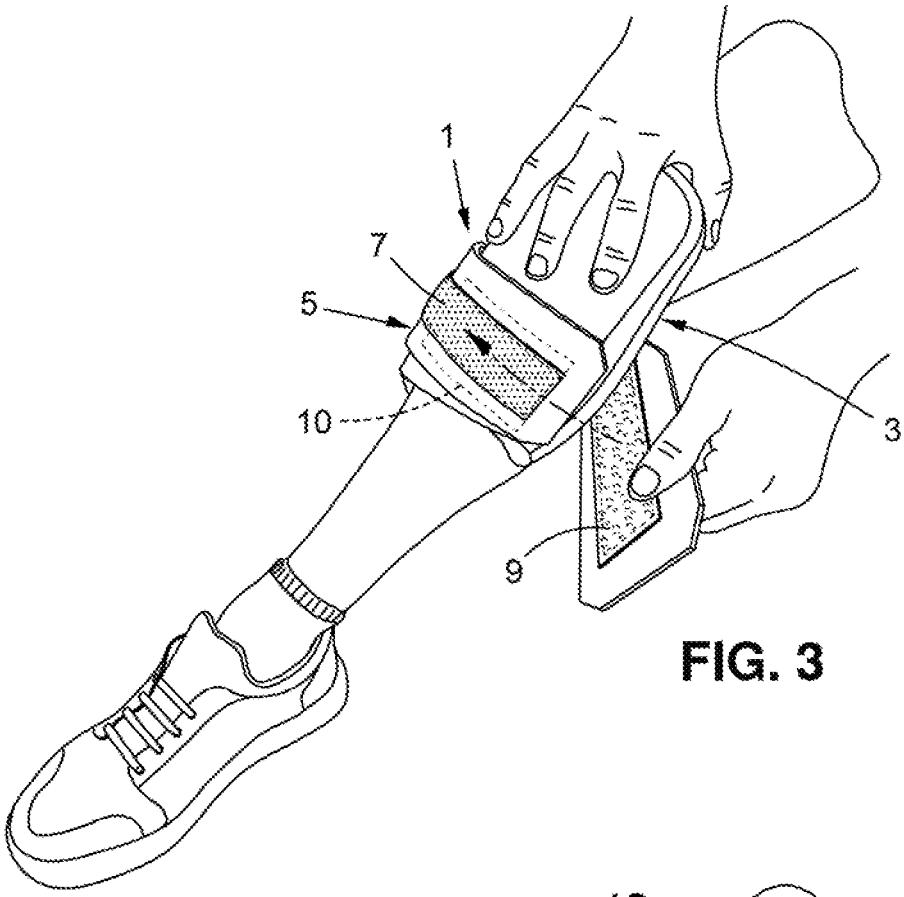
Figure 4:
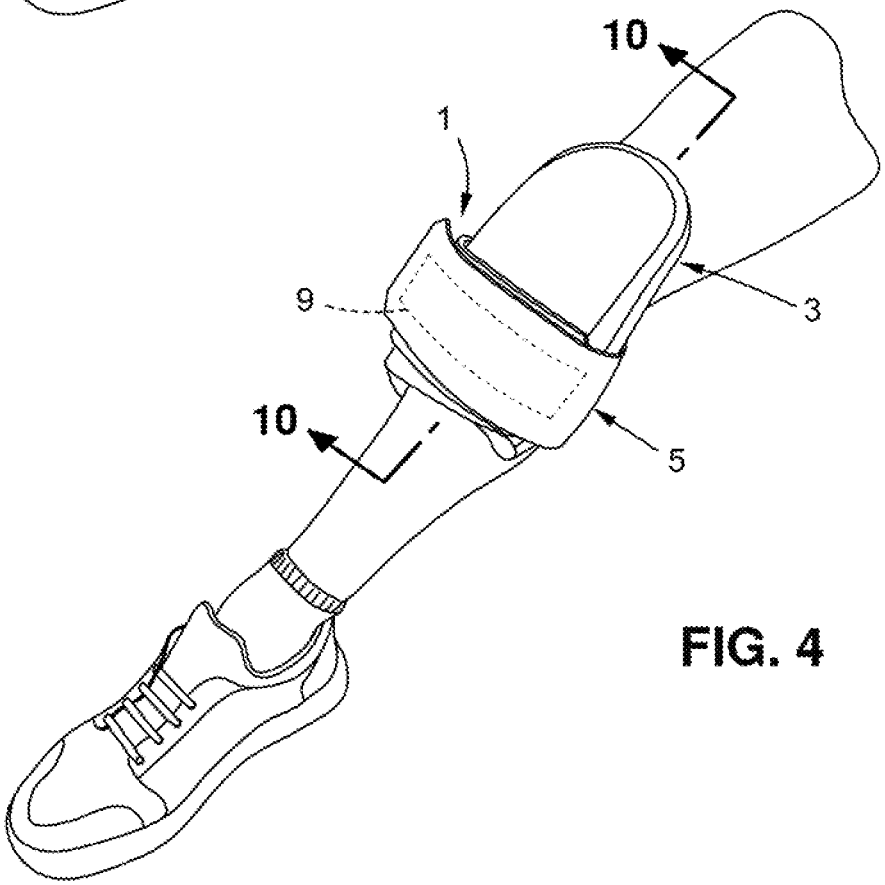

With the first end of the knee pad strap 5 attached to the knee pad 3, the workman uses his second hand to move the opposite end of the knee pad strap 5 underneath his leg (best shown in FIG. 2). The opposite end of the strap 5 is wrapped completely around the shin of the workman's leg, and the second piece of fastener material 9 lying at the bottom of the opposite end of strap 5 is pressed into detachable mating engagement with the first piece of fastener material 7 lying at the top of the first end of the strap (best shown in FIG. 3).

The knee pad strap 5 now encircles the knee pad 3 of the knee pad assembly 1 and the workman's shin against which the knee pad 3 is held (best shown in FIG. 4) so that both the workman's knee and shin are covered and protected by the knee pad 3. If a second knee pad strap 5 is used to hold a second knee pad 3 against the other knee and shin of the workman, the strap will extend from his leg and be wrapped in an opposite direction to that shown in FIG. 2. The size and position of the first and second pieces of fastener material 7 and 9 can be adjusted to achieve a tight or a loose fit according to the needs of the workman.

Because of its flexible characteristics, the knee pad strap 5 is adjustable side-to-side and/or up and down along the workman's leg so as to correspondingly adjust the position of the knee pad 3 relative to the workman's knee as may be necessary to enhance the knee pad's effectiveness and the workman's comfort. When the job has been completed, the knee pad strap 5 is simply unwound, whereby the strap 5 is pulled off and detached from the knee pad 3, and the knee pad 3 is removed from the workman's leg.

Figure 8:
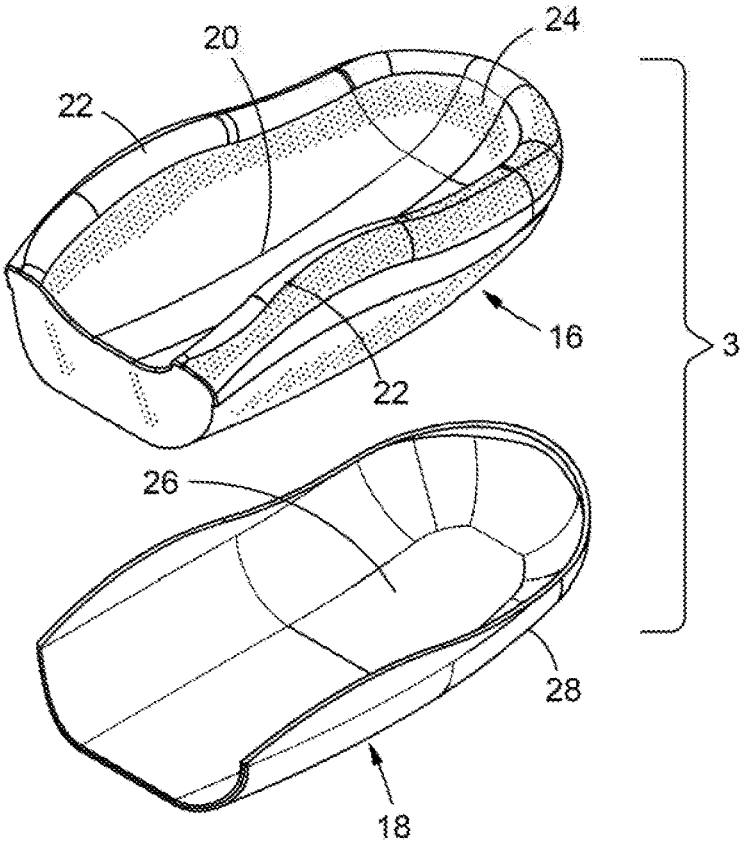
FIGS. 8 and 9 are exploded top and bottom views showing a flexible upper knee cushion and a rigid lower base to be attached one above the other to form the knee pad of the knee pad assembly.
Figure 9:
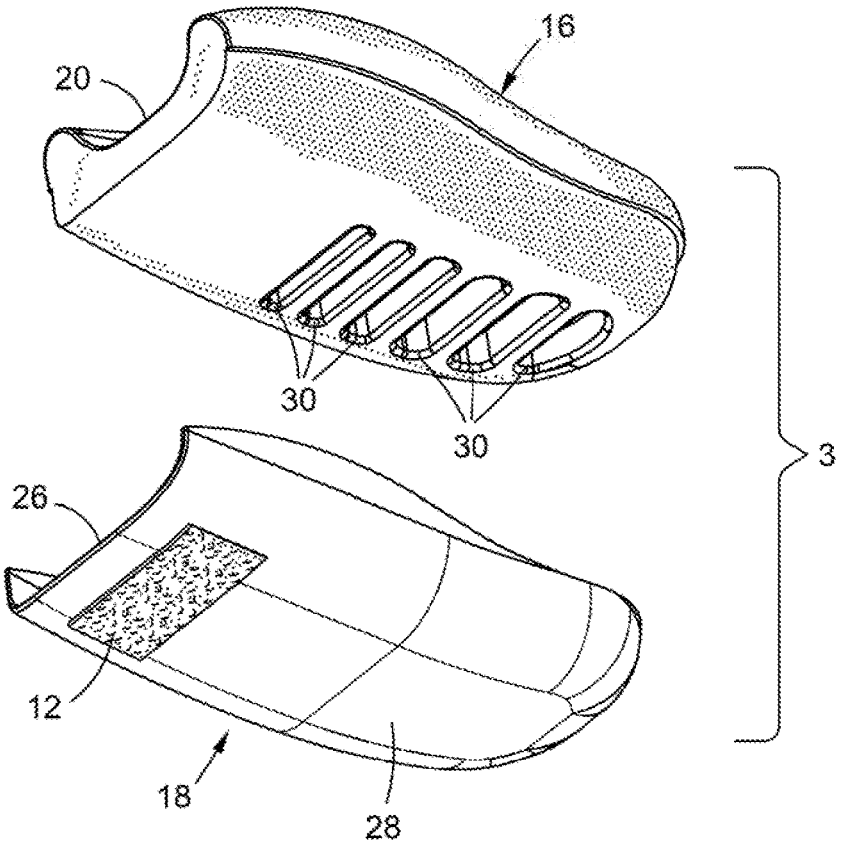

Details of the flexible knee pad 3 of the knee pad assembly 1 shown in FIGS. 1-4 are now provided while referring concurrently to FIGS. 8-13 of the drawings. As is best shown in FIGS. 8 and 9, the knee pad 3 includes a relatively soft and flexible upper knee cushion 16 and a relatively hard lower base 18. The upper knee cushion 16 of the knee pad 3 is preferably manufactured from a resilient and compressible cushion material such as foam or the like, and the lower base 18 is preferably manufactured from a rigid and non-compressible impact resistant material such as plastic or the like.

The relatively soft upper knee cushion 16 of the knee pad 3 of the knee pad assembly 1 has a shin receiving depression 20 extending longitudinally along the rear end thereof. The front end of the upper knee cushion 16 is rounded and closed, and the opposite rear end is open. The shin receiving depression 20 is sized and configured to receive therewith and cover the workman's shin which lies just below the knee that is to be protected from its contact with the work surface. The periphery 22 of the shin support cavity 20 bends inwardly (best shown in FIG. 8) so as to conform to and fit around the workman's shin when his leg is received within the depression 20. The front end of the upper knee cushion 16 of the knee pad 3 has a knee pocket 24 formed therein that communicates with and lies opposite the shin receiving depression 20. The knee pocket 24 is sized and configured to receive therewithin and surround the workman's knee.

The relatively hard lower base 18 of the flexible knee pad 1 of the knee pad assembly 1 has a generally U-shaped cavity 26 extending longitudinally therealong (best shown in FIG. 8). The front end of the lower base 18 is rounded and closed, and the opposite rear end is open. The U-shaped cavity 26 is sized and configured to receive therewithin and surround the upper knee cushion 16. More particularly, the bottom of the upper knee cushion 16 lays against and is affixed (e.g., adhesively bonded) to the lower base 18 within the U-shaped cavity 26 thereof to complete the flexible knee pad 3 of knee pad assembly 1. The lower base 18 of the knee pad 3 functions as a hard protective shell below the upper knee cushion 16 to lay on and rock back and forth over the work surface.

Figure 11:
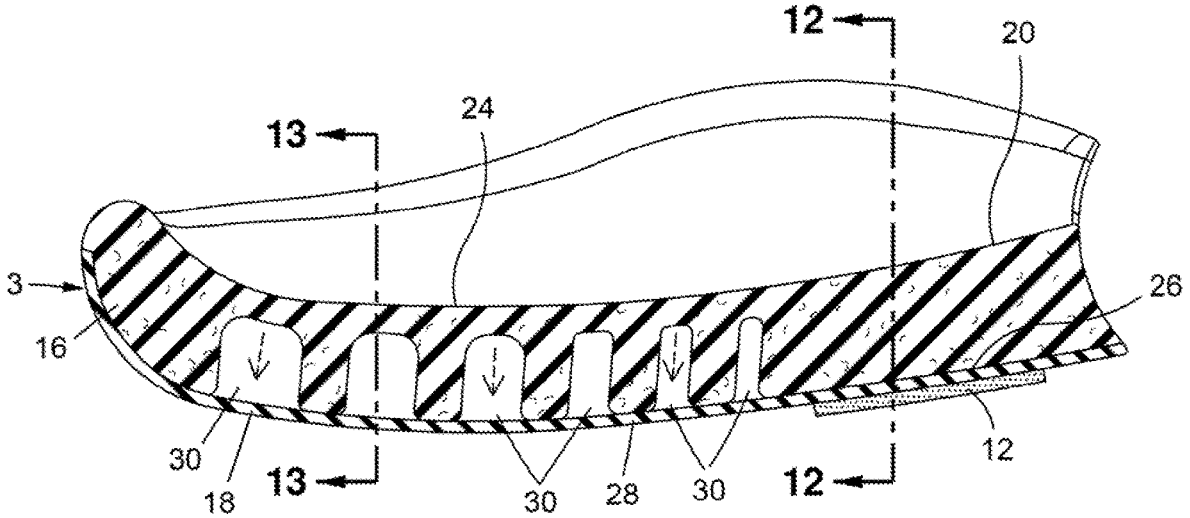
FIG. 11 is an enlarged cross-section of the flexible upper knee cushion and the lower rigid base of the knee pad shown in FIG. 10.
Figure 12:
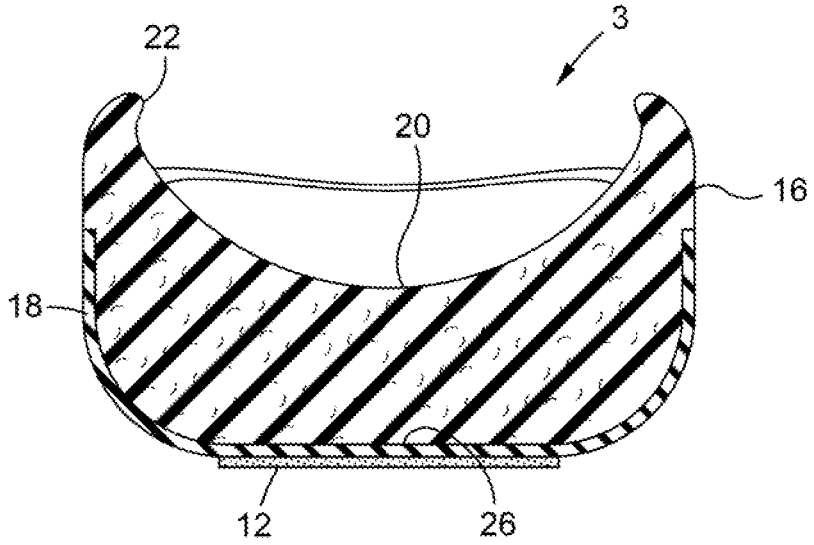
FIG. 12 is a cross-section of the knee pad of the knee pad assembly taken along lines 12-12 of FIG. 11.

That is, and as is best shown in FIG. 11, the bottom 28 of the lower base 18 that lies under the knee pocket 24 of the upper knee cushion 16 in which the workman's knee is received is continuously curved along the longitudinal axis of the knee pad 3 that runs between the front and the back thereof. Thus, when the workman rocks back and forth the knee pad 3 only contacts the work surface along a single line that runs laterally across the lower base 18 and perpendicular to the longitudinal axis of the knee pad 3 around which the knee pad 3 rotates when the workman shifts his weight and rocks back and forth during the job. By virtue of the foregoing, the impact force generated by the work surface toward the workman's knee is distributed along the curved rigid lower base 18 so that less pressure will be concentrated directly against the workman's knee regardless of how much his knee is bent. However, it is within the scope of this invention for the continuously curved lower base 18 of knee pad 3 to have one or more flat zones to provide an area of stability when the workman rocks back and forth.

Figure 13:
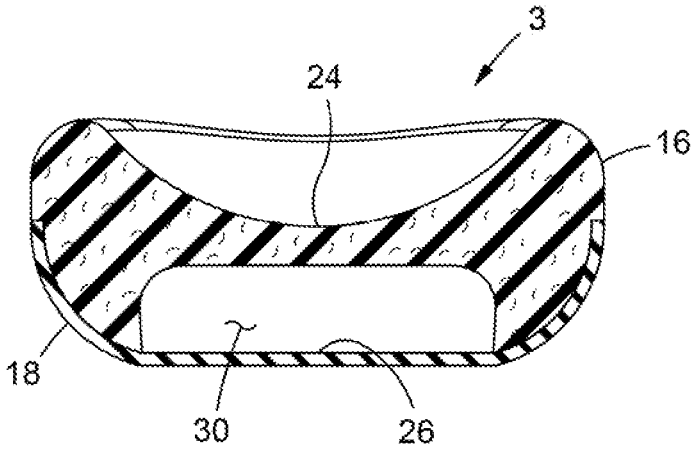
FIG. 13 is a cross-section of the knee pad of the knee pad assembly taken along lines 13-13 of FIG. 11.
Figure 14:
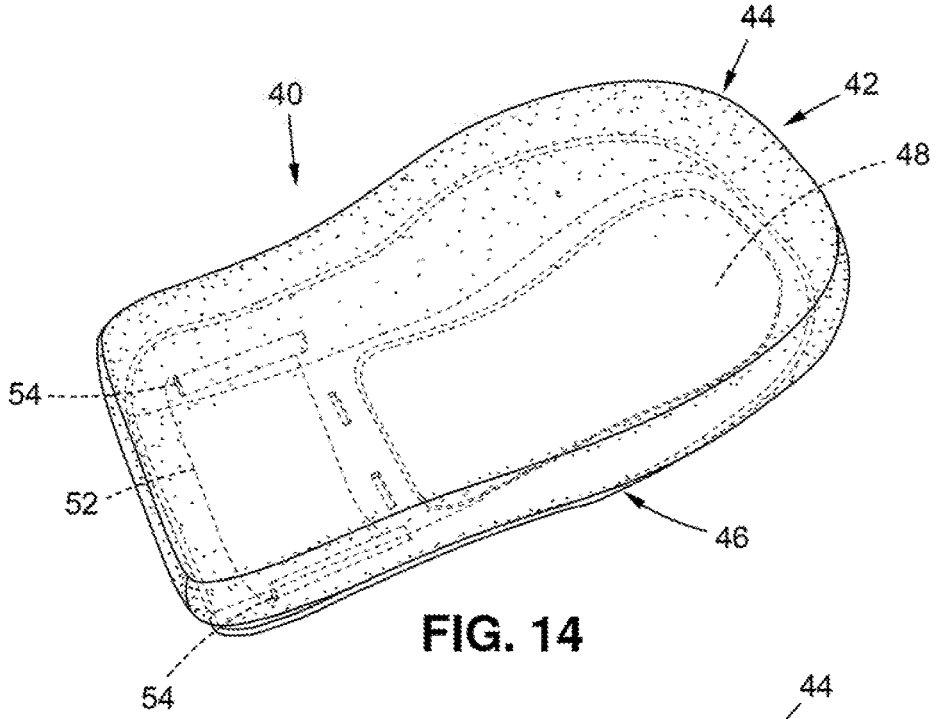
FIG. 14 shows a second embodiment for a knee pad assembly including a knee pad to be held over and against the knee and shin of a workman.
Figure 15:
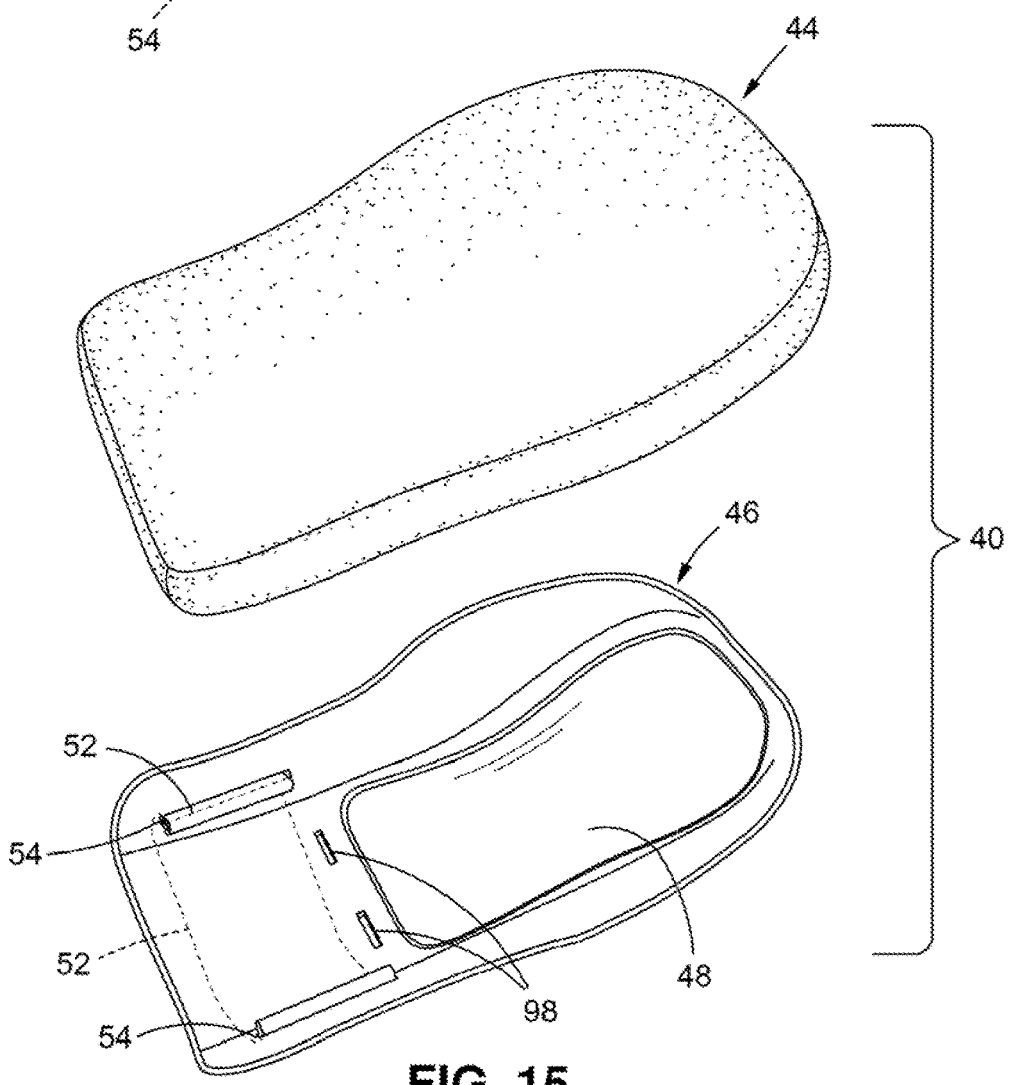
FIG. 15 is a top exploded view of the knee pad assembly shown in FIG. 14.
Figure 16:
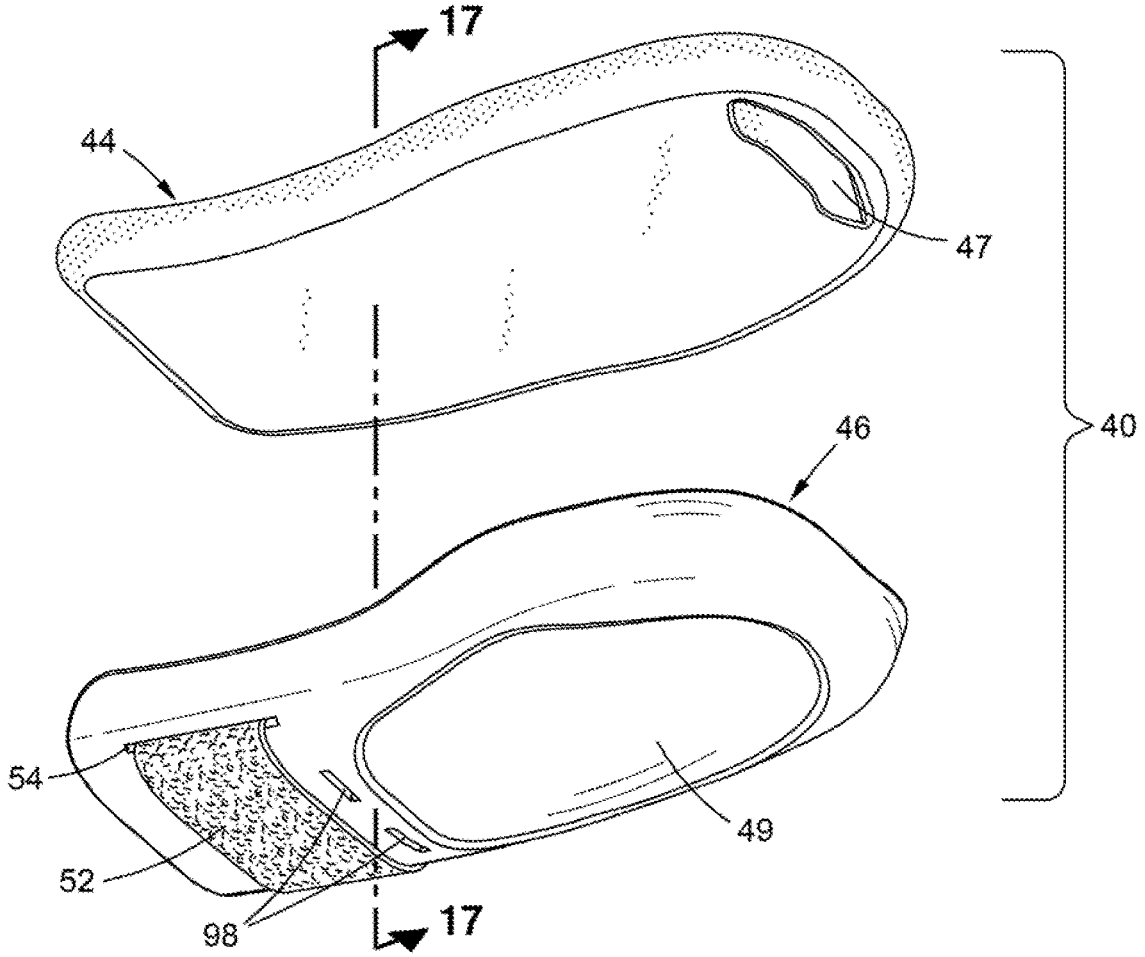
FIG. 16 is a bottom exploded view of the knee pad assembly shown in FIG. 14.
Figure 17:
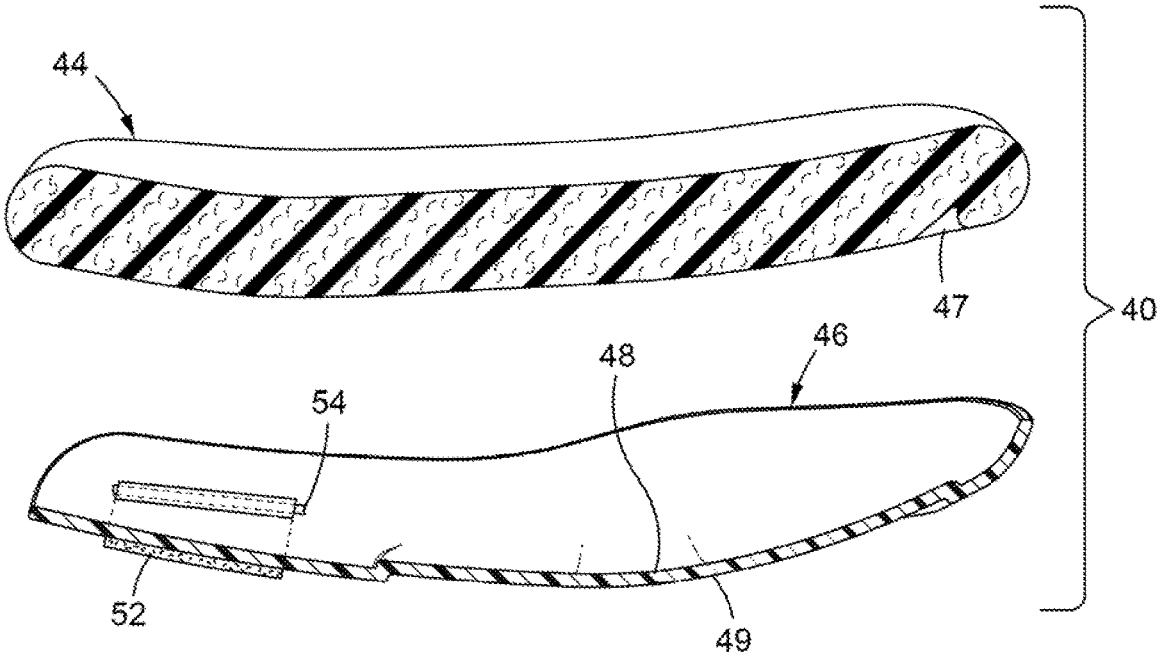
FIG. 17 is a cross-section of the knee pad assembly shown in FIG. 14 taken along lines 17-17 of FIG. 16.

As is best shown in FIGS. 9-1I and 13, a set of spaced, parallel aligned and upwardly extending openings (e.g., channels) 30 are formed in the bottom of the upper knee cushion 16 of the knee pad 3 below the knee pocket 24 thereof in which the workman's knee is received. The set of openings 30 creates a compression zone within the upper knee cushion 16. In particular, the compression zone created in the upper knee cushion 16 by the openings 30 formed in the bottom of the flexible upper knee cushion 16 is adapted to collapse downwardly towards the relatively hard lower base 18 (in the direction of the reference arrows shown in FIG. 11) in response to the pressure of the workman's knee pressing downwardly against the relatively soft upper knee cushion 16 as he rocks back and forth on the work surface.

In this manner, the knee pocket 24 at the front end of the upper knee cushion 16 is correspondingly compressed against the lower base 18. By virtue of the foregoing, the depth of the knee pocket 24 in which the workman's knee is received is increased depending upon the magnitude of the pressure generated by the workman's knee towards cushion base 18. A deeper knee pocket 24 prevents the workman's knee from unintentionally moving out of the knee pocket 24 and sliding past the closed front end of the upper knee cushion 16 of the knee pad 3. Accordingly, and as is best shown in FIG. 10, with the knee pad 3 held against the workman's shin and knee by the knee pad strap 5 in the manner previously explained, the workman's knee is suspended above the work surface and cushioned by the upper knee cushion 16. Thus, the pressure being applied by the workman's knee towards the work surface is advantageously absorbed and distributed away from being concentrated directly against the workman's knee as the upper knee cushion 16 of the flexible knee pad 3 is compressed in response to such pressure.

Another knee pad assembly 40 which achieves the objectives of this invention by reducing the potential injury to a workman kneeling on a hard work surface is described while referring to FIGS. 14-19 of the drawings. As in the case of the knee pad assembly 1 shown in FIGS. 1-13, the knee pad assembly 40 includes a knee pad 42 having a flexible upper knee cushion 44 and a rigid lower base 46 that establishes a protective outer shell. The upper knee cushion of the knee pad 42 is preferably manufactured from flexible foam, or the like. A collapse zone or void 47 is formed in the front of the knee cushion 44.

The lower base 46 of the knee pad 42 is preferably manufactured from a rigid plastic, or the like, with a generally U-shaped cavity 48 formed therein. Located at the bottom of the lower base 46 between the front and approximately the midpoint thereof is a scuff guard recess 49 (best shown in FIG. 16). A durable scuff guard 50 is bonded to the bottom of the lower base 46 within the scuff guard recess 49. The scuff guard 50 is preferably manufactured from a non-marking rubber, or the like. The scuff guard 50 lies within the scuff guard recess 49 so as to project slightly outwardly (i.e., downwardly) therefrom (best shown in FIG. 18) to prevent the surface on which the workman is kneeling from being scuffed as the workman rocks and slides back and forth. A piece of hook and loop fastener material (e.g., Velcro®) 52 is attached to the bottom of the lower base 46 behind the scuff guard recess 49. A complementary piece of fastener material from a knee pad strap (designated 56 in FIGS. 18 and 19) is attached to the fastener material 52 by which the knee pad 42 is correspondingly attached to the knee pad strap 56. A pair of fastener slots 54 (best shown in FIGS. 16 and 17) are formed in opposite sides of the lower base 46 through which opposite ends of the piece of fastener material 52 are fed to be attached to the inside of lower base 46. The lower base 46 of the knee pad 42 is configured to receive the upper knee cushion 44 within the U-shaped cavity 48 thereof. The upper knee cushion 44 may be affixed to the lower base 46 by means of adhesive or by means of opposing pieces of fastener material (e.g., Velcro®).

Figure 18:
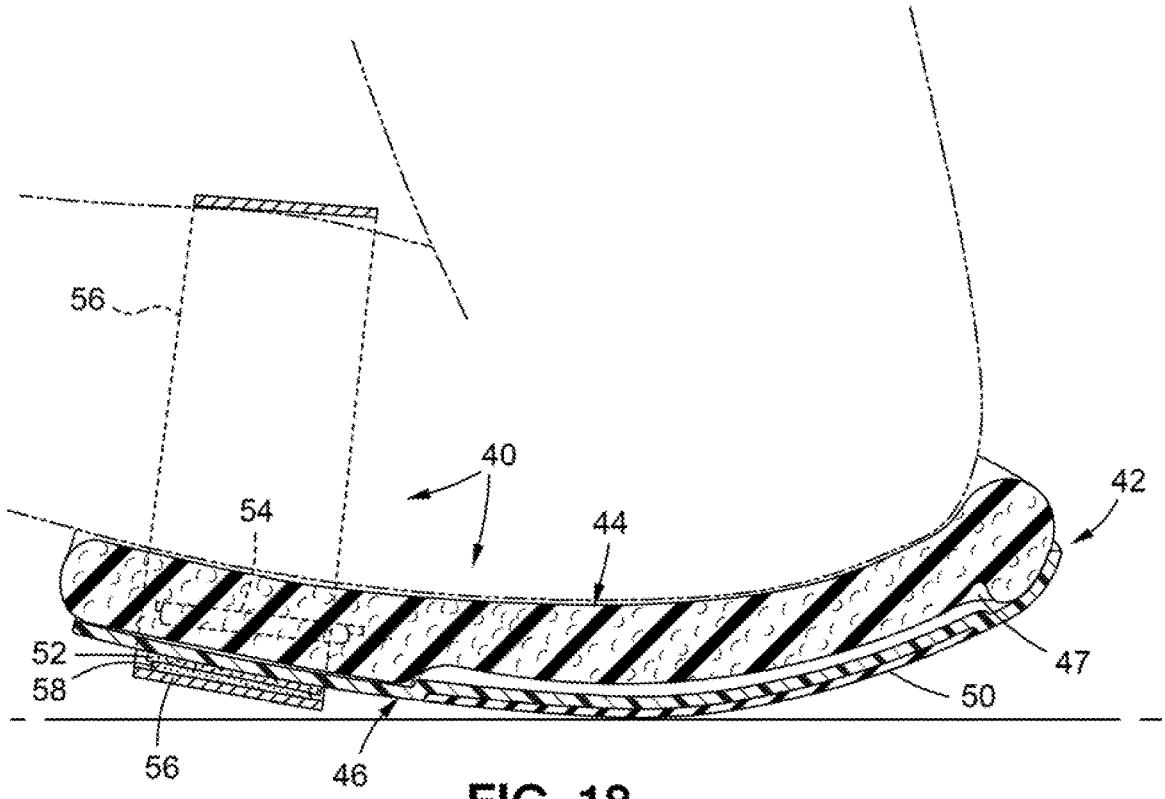
FIG. 18 is a cross-section of the knee pad assembly of FIG. 14 with the knee pad thereof being held by a knee pad strap against the knee and shin of a workman kneeling on a work surface while holding his torso erect.
Figure 19:
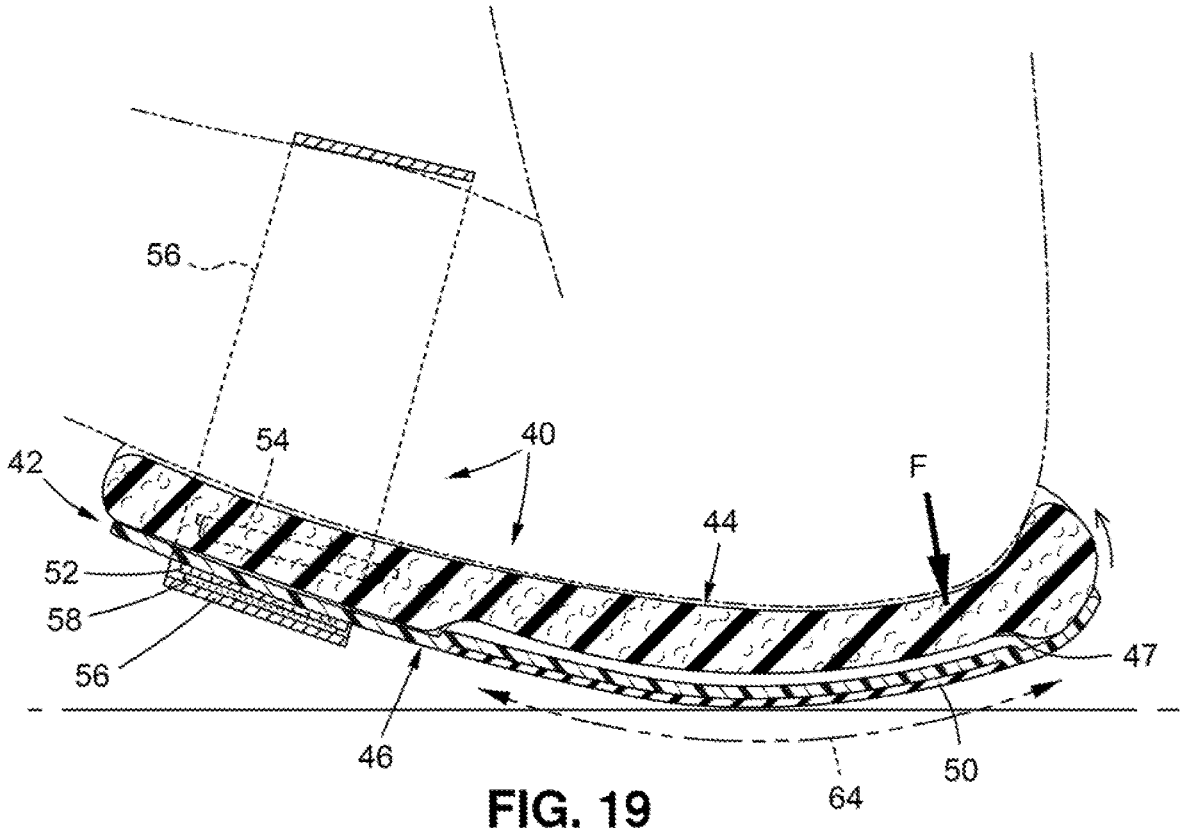
FIG. 19 is a cross-section of the knee pad assembly of FIG. 14 with the knee pad thereof being held by the knee pad strap against the knee and shin of the workman while shifting his weight forward on the work surface.
Figure 20:
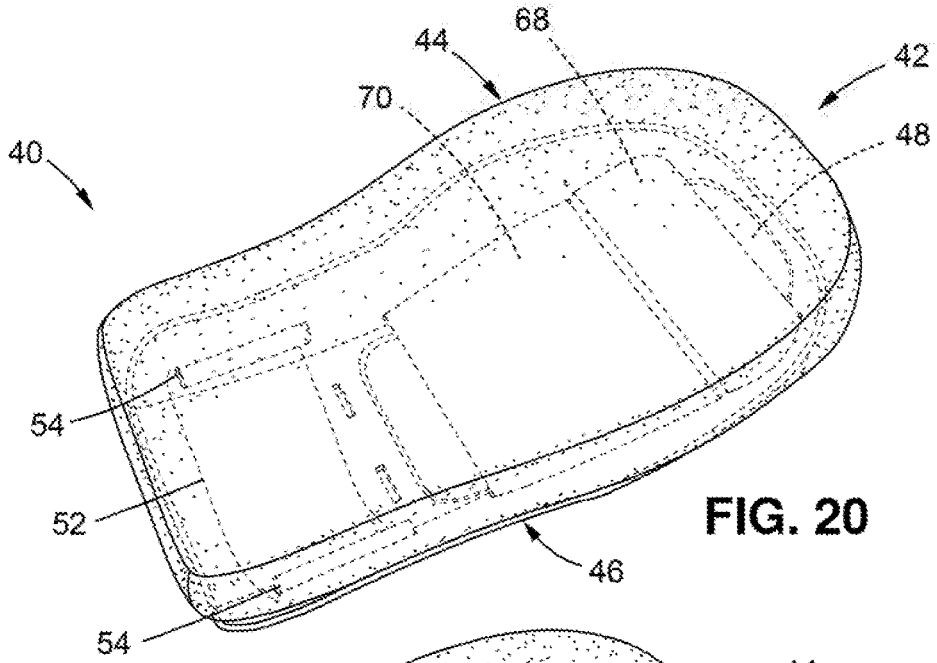
FIG. 20 shows a third embodiment for a knee pad assembly including a knee pad to be held over and against the knee and shin of a workman.
Figure 21:
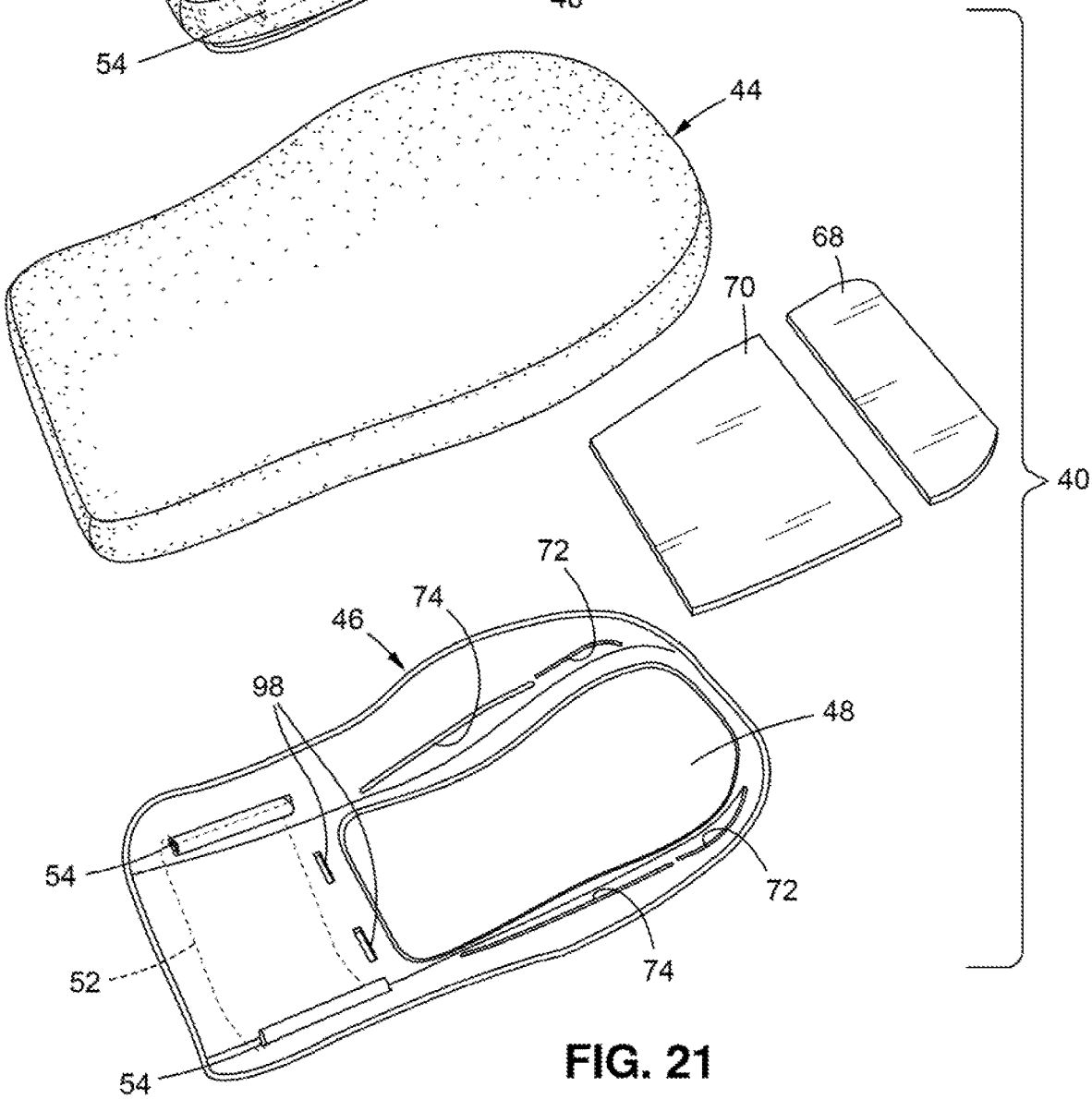
FIG. 21 is a top exploded view of the knee pad assembly shown in FIG. 20.
Figure 22:
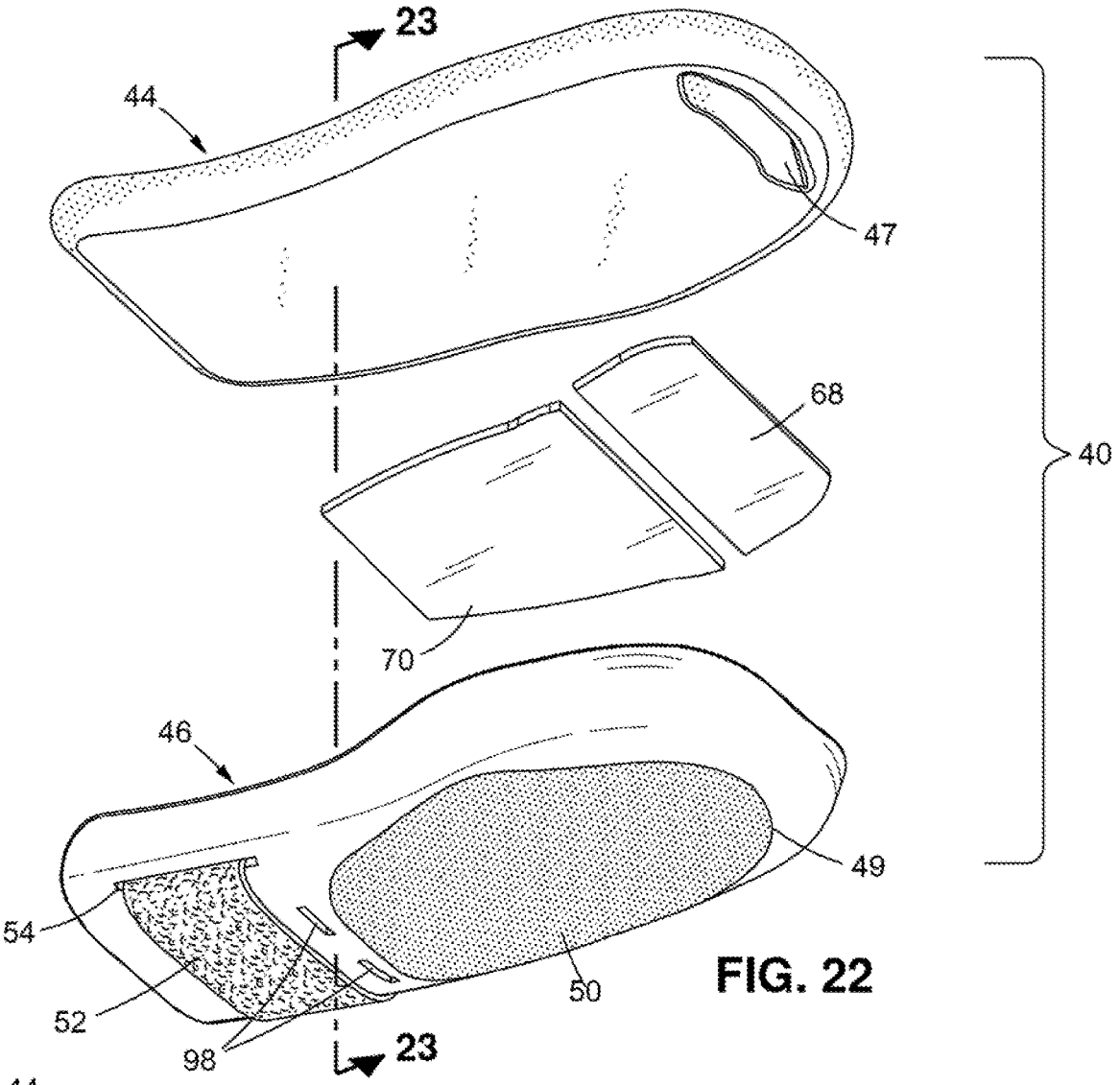
FIG. 22 is a bottom exploded view of the knee pad assembly shown in FIG. 20.
Figure 23:
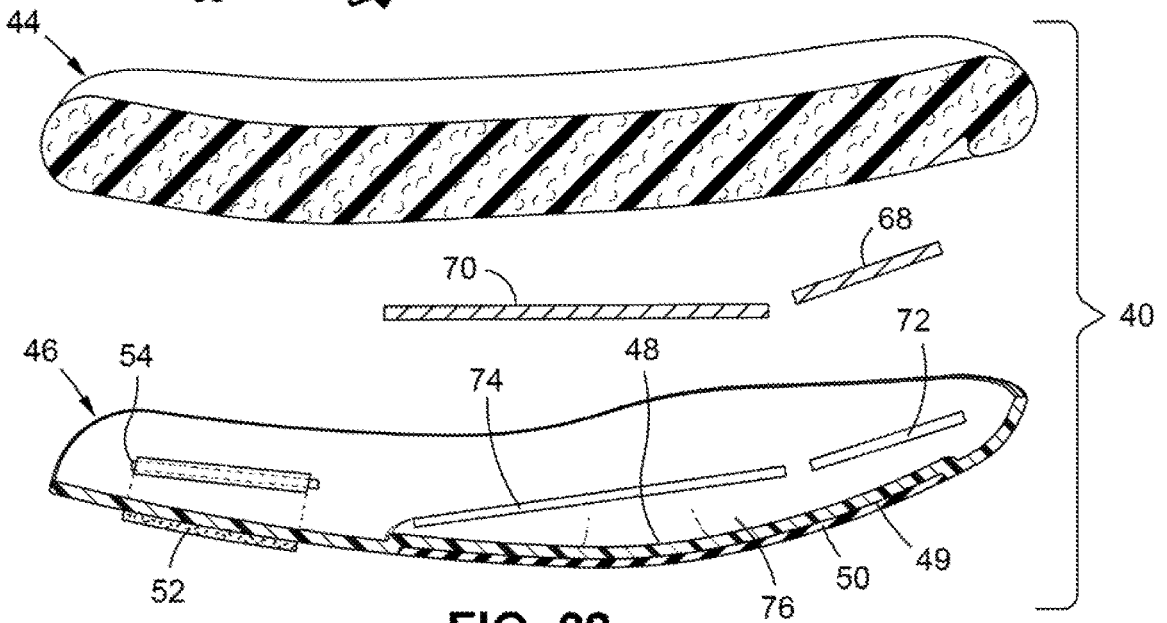
FIG. 23 is a cross-section of the knee pad assembly of FIG. 20 taken along lines 23-23 of FIG. 22.

Referring particularly to FIGS. 18 and 19, the upper knee cushion 44 and the lower base 46 are shown attached to one above the other to form the knee pad 42, and the knee pad strap 56 is shown attached to the knee pad to complete the knee pad assembly 40. That is, and as was just explained, a piece of fastener (Velcro®) material 58 that is carried by the knee pad strap 56 is moved into mating engagement with the fastener material 52 that is located at the bottom of the lower base 46 of the knee pad 42 in a manner similar to that illustrated in FIGS. 1 and 2 so that the knee pad strap 56 is now removable attached to the lower base 46. The knee pad strap 56 is then wrapped around the shin of the workman in a manner similar to that illustrated in FIGS. 3 and 4.

As an important feature of the knee pad assembly 40 shown in FIGS. 18 and 19, the bottom of the lower base 46 of the knee pad 42 is continuously curved along the longitudinal axis of the knee pad between the front and the back thereof. Thus, when the workman rocks back and forth, the knee pad assembly 42 will only contact the surface on which the workman is working along a single line that runs laterally across the lower base 46 and perpendicular to the longitudinal axis of the knee pad 42. By virtue of the foregoing, the weight of the workman kneeling and rocking on a work surface will be distributed along the continuously curved rigid lower base 46 so that less pressure will be focused directly on the workman's knee and shin. However, as was earlier explained when referring to the knee pad 3 shown in FIG. 9, the lower base 46 of knee pad 42 of FIGS. 18 and 19 may have one or more flat zones to provide stability to the workman as he rocks back and forth.

FIG. 18 shows the workman wearing the knee pad assembly 40 to cover his knee and shin while kneeling on the work surface and holding his torso erect. FIG. 19 shows the kneeling workman when he shifts his weight and leans forward on the work surface. As just explained, as the workman rocks back and forth in the directions of the reference arrows 64 of FIG. 19, his weight and the opposite force generated by the work surface will be distributed along the continuously curved lower base 46 of the knee pad 42 and concentrated less on his knee and shin. What is more, and as shown in FIG. 19, the previously described collapse zone void 47 that is located at the front of the flexible upper knee cushion 44 is now collapsed by the workman's forward shifting weight and the corresponding pushing force (designated F) generated thereby so that the front of the upper knee cushion 44 is compressed against the lower base 46. By virtue of this compression, the workman's knee is pressed deeper into the lower base 46, and, therefore, the likelihood of the workman's knee sliding past the lower base 46 and off the front of the knee pad 42 is reduced.

FIGS. 20-25 of the drawings show a modification to the knee pad assembly 40 that is shown in FIGS. 14-19. More particularly, a pair of springs 68 and 70 are attached to the lower base 46 of the knee pad 40 within the U-shaped cavity 48 thereof so as to lie below the upper knee cushion 44 and above the scuff guard recess 48 of FIG. 22 that is formed in the bottom of the lower base. By way of example, the springs 68 and 70 are thin flexible sheets that are manufactured from carbon fiber and have a spring memory so as to be capable of flexing to establish a shock absorber for dissipating the forces that are applied thereto by the knee of a workman kneeling on the work surface. One of the sheet springs 70 may be larger than the other 68, and the springs 68 and 70 are preferably spaced from one another to enable them to flex independently of one another.

To space the spring sheets 68 and 70 above the U-shaped cavity 48 of the lower base 46 of the knee pad 42, first and second pairs of shoulders 72 and 74 are formed (e.g., molded) in the opposite side walls of lower base 46. A first (i.e., the smaller) of the flexible spring sheets 70 is seated on the first pair of shoulders 72 so as to extend laterally across the front of the lower base 46. The second (i.e., the larger) of the flexible spring sheets 72 is seated on the second pair of shoulders 74 so as to also extend laterally across the lower base 46 behind the first spring sheet 68. The spring sheets 68 and 70 are preferably taped or adhesively bonded to their respective pair of shoulders 72 and 74.

Figure 24:
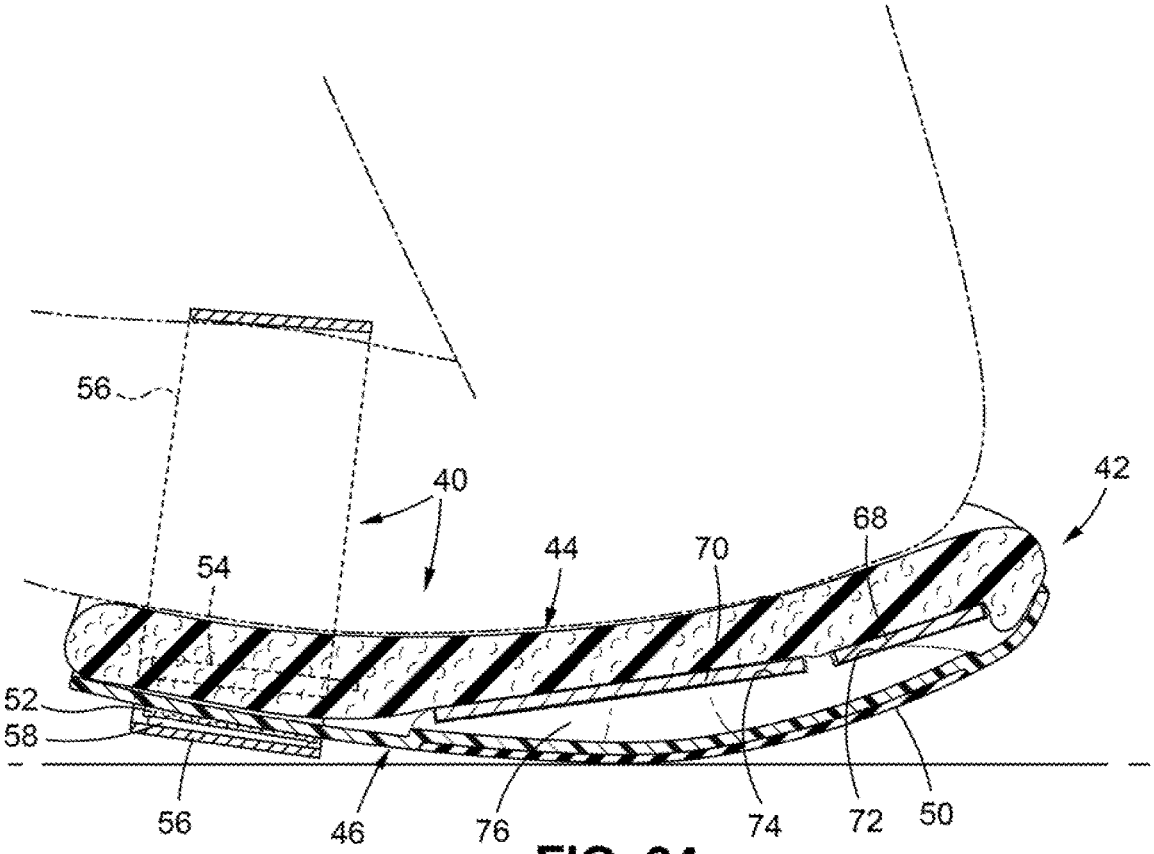
FIG. 24 is a cross-section of the knee pad assembly of FIG. 20 with the knee pad thereof being held by a knee pad strap against the knee and shin of a workman kneeling on a work surface while holding his torso erect.
Figure 25:
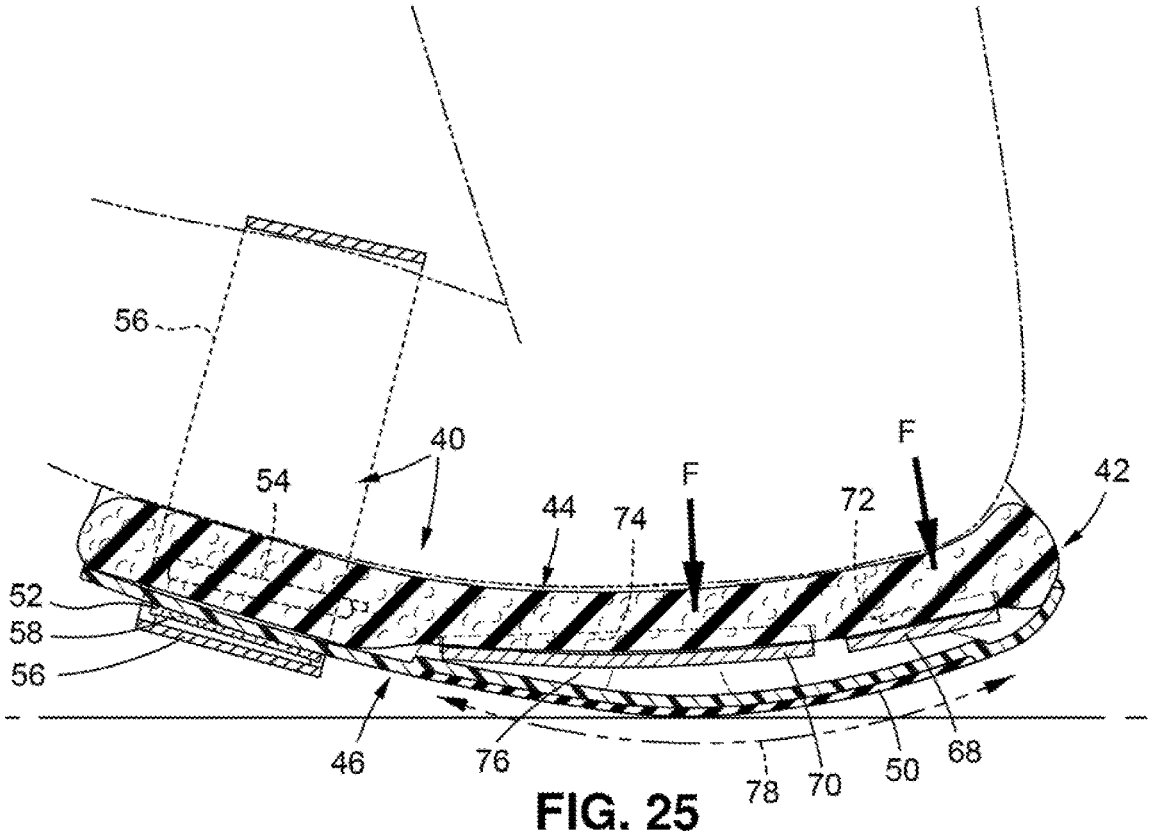
FIG. 25 is a cross-section of the knee pad assembly of FIG. 20 with the knee pad thereof being held by the knee pad strap against the knee and shin of the workman while shifting his weight forward on the work surface.

The flexible upper knee cushion 44 is located within the U-shaped cavity 48 of the lower base 46 so as to lay upon the pair of spring sheets 68 and 70. FIG. 24 shows the workman kneeling on the work surface with the knee pad 42 held against his knee and shin by means of the knee pad strap 56 surrounding his shin below the knee. The workman's knee is advantageously suspended by the upper knee cushion 44 and the spring sheets 68 and 70 above the work surface. In this case, the workman's torso is held vertically erect so that a minimum force is applied from his knee to the knee pad 42. The sheet springs 68 and 70 on which the upper knee cushion 44 lays are relaxed and at rest so that a relatively large compression space 76 is established between the upper knee cushion 44 and the lower base 46.

In FIG. 19, the kneeling workman is shown leaning forward on the work surface so that his weight is now shifted forward. In this case, downward pushing forces (designated F) generated by the workman's knee are applied to the flexible upper knee cushion 44 which is compressed. The pushing forces are transferred to the pair of flexible spring sheets 68 and 70 on which the upper knee cushion 44 lays. The spring sheets 68 and 70 are now stressed in response to the pushing forces F generated by the workman's knee. Accordingly, the spring sheets 68 and 70 will bend or flex downwardly, and the size of the compression space 76 between the upper knee cushion 44 and the lower base 46 is reduced.

By virtue of the foregoing, the pushing forces will be distributed along the workman's knee and shin as the upper knee cushion 44 is compressed so as to relieve the pressure that would otherwise be concentrated against the workman's knee. At the same time, and similar to that described while referring to FIGS. 14-19, the weight of the kneeling workman is also distributed along the continuously curved bottom of the lower base 46 as he rocks back and forth in the directions of the reference arrows 78 of FIG. 25. When the compression area 76 is reduced in size and the workman's knee is pressed deeper into the lower base 46, the likelihood of the workman's knee sliding off the front of the knee pad 42 is reduced.

Figure 26:
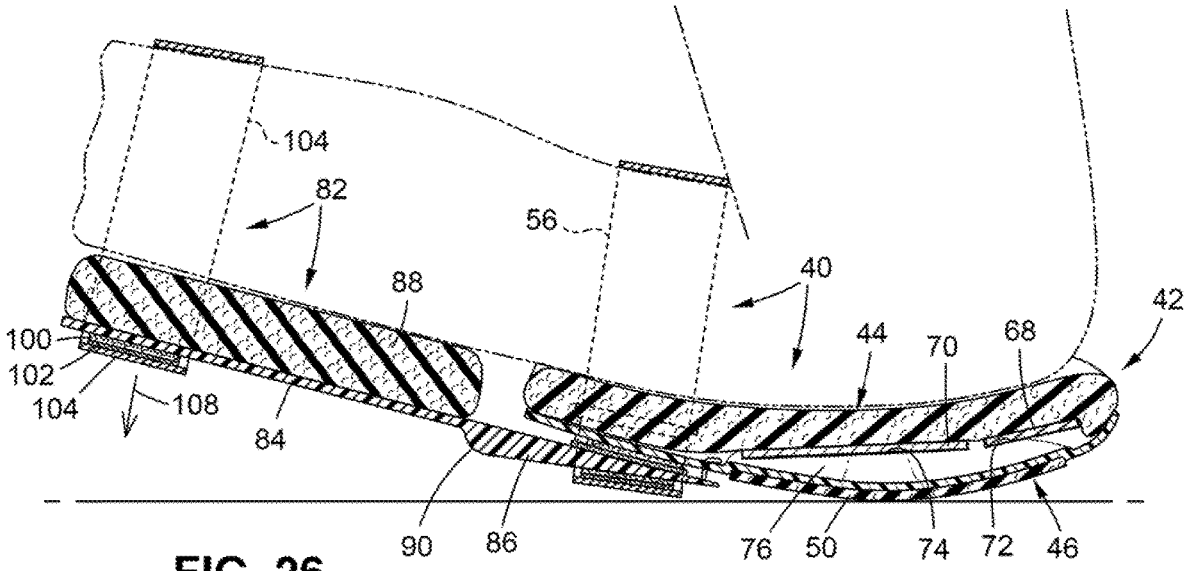
FIG. 26 is a cross-section of the knee pad assembly shown in FIG. 25 having a supplemental shin support detachably connected thereto.
Figure 27:
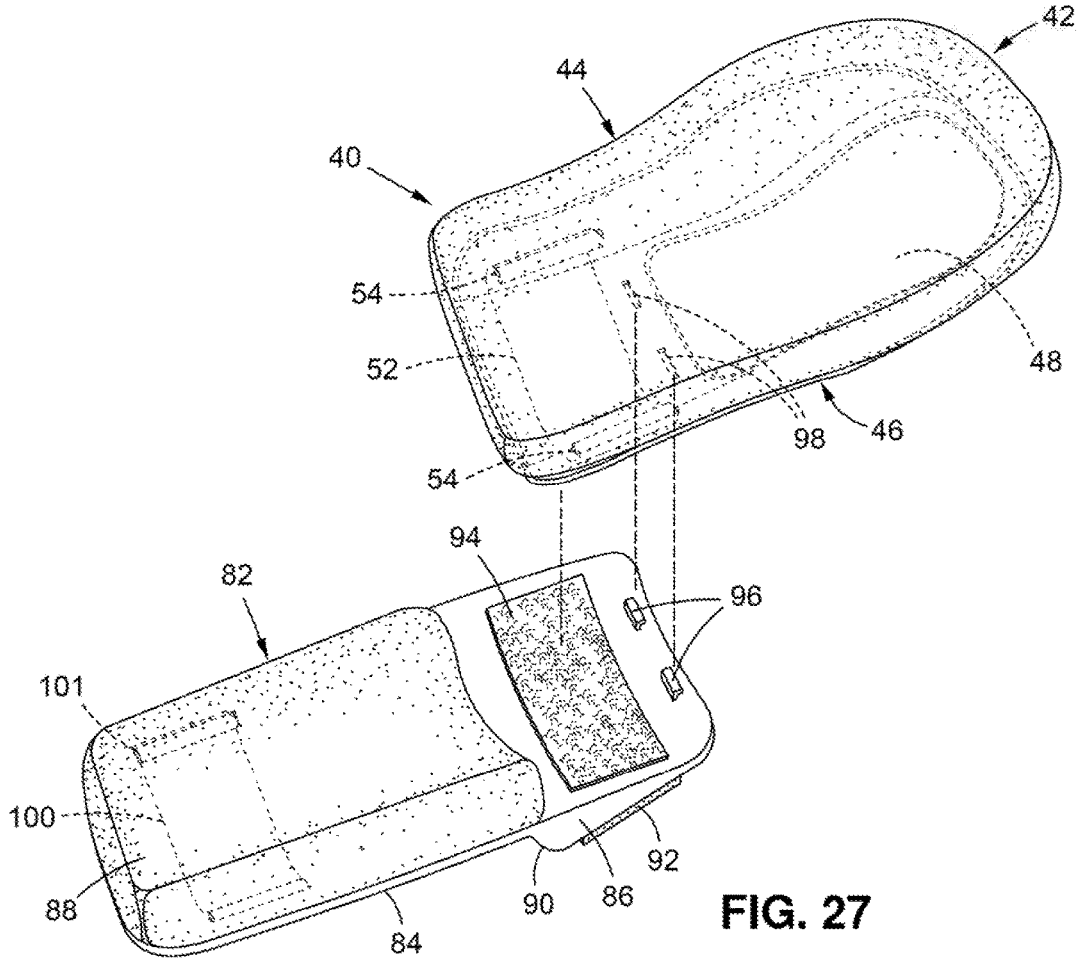
FIG. 27 is an exploded view of the combination knee pad assembly and supplemental shin support shown in FIG. 26.

FIGS. 26 and 27 of the drawings show an addition to the knee pad assembly 40 that is shown in FIGS. 20-25. More particularly, an optional supplemental shin support 82 is described that is detachably connected to the rigid lower base 46 of the knee pad assembly 40. The shin support 82 includes a planar rolling base 84 that is preferably manufactured from a hard plastic material that may be identical to the material from which the rigid lower base 46 of the knee pad 42 is manufactured. A generally triangular pivot base 86 is coextensively connected to and extends downwardly from the bottom of the rolling base 84 at a first end thereof. A flexible shin cushion 88 is affixed (e.g., adhesively bonded) to the top of the rolling base 84 at the opposite end. The shin cushion 88 is manufactured from a flexible material (e.g., foam) that may be identical to the material from which the flexible upper knee cushion 44 of the knee pad 42 is manufactured.

The triangular pivot base 86 of the shin support 82 has a round nose 90 located below the rolling base 84 and lying about midway between the first and opposite ends thereof. A first piece of hook and loop fastener material (e.g., Velcro®) 92 is affixed (e.g., adhesively bonded) to the bottom of the pivot base 86 below the first end of the rolling base 84. A second piece of fastener material 94 is affixed to the top of the rolling base 84 above the first piece 92. The function of the first and second pieces of fastener material 92 and 94 will soon be explained.

As is best shown in FIG. 27, a pair of hook-shaped coupling tabs 96 stand upwardly from the first end of the rolling base 84 of the shin support 82. As is also best shown in FIG. 27, a corresponding pair of coupling slots 98 are formed in the bottom of the lower base 46 of the knee pad 42. The supplemental shin support 82 is detachably connected to the rear of the knee pad 42 of the knee pad assembly 40 when the coupling tabs 96 are removably received by and pushed into the coupling slots 98. In this case, and as is best shown in FIG. 26, the shin support 82 connected to the knee pad assembly 40 extends between and covers the workman's knee and shin.

In particular, a third piece of fastener material 100 is attached below the shin support 82 at the bottom of the opposite end of the rolling base 84. Opposite ends of the third piece of fastener material 100 are fed through fastener slots 101 formed in opposite sides of rolling base 84 to be attached to the top of the rolling base. A complementary fourth piece of fastener material (designated 102 in FIG. 26) is attached to a shin support strap 104 that may be identical to the knee pad strap 56 earlier described. The shin support strap 104 is detachably connected to the shin support 82 at the bottom of the rolling base 84 thereof when the third and fourth pieces of fastener material 100 and 102 are moved into mating engagement with one another. The shin support strap 104 is then wrapped around the workman's shin to hold the flexible shin cushion 88 of the shin support 82 over and against the shin of the workman to provide protection to his shin and ankle as he kneels down and rocks back and forth on the work surface.

With the supplemental shin support 82 detachably connected to and extending from the back of the knee pad 42 of the knee pad assembly 40 as shown in FIG. 26, the previously described knee pad strap 56 is wrapped around the workman's leg below his knee and above the shin support strap 104. In this case, however, the knee pad strap 56 is detachably connected to the shin support 82 when the piece of fastener material 58 (of FIGS. 18 and 19) of knee pad strap 56 is moved into mating engagement with the first piece of fastener material 92 (of FIG. 27) that is attached to the pivot base 86 below the first end of the rolling base 84. Likewise, the second piece of fastener material 94 that is attached to the top of the rolling base 84 at the first end thereof is moved into mating engagement with the piece of fastener material 52 that is attached to the bottom of the lower base 46 of the knee pad 42.

By virtue of the connection of the knee pad assembly 40 to the supplemental shin support 82 as shown in FIG. 26, the force to which the workman's shin and ankle are exposed when the workman kneels on the work surface is absorbed and distributed therealong by the flexible shin cushion 88. What is more, the combination knee pad assembly 40 and shin support 82 can rotate smoothly and pivot up or down at the round nose 90 of the pivot base 86 below the front end of the rolling base 84 as the workman rocks back and forth on the work surface. That is, when the workman shifts his weight forward and the shin support 82 rotates upwardly around the rounded nose 90 and off the work surface, as shown, the pressure is directed away from his shin and ankle to be absorbed by the flexible upper knee cushion 44. When the workman shifts his weight back and the shin support 82 rotates downwardly towards the work surface in the direction of the reference arrow 108 of FIG. 26, the pressure is directed away from his knee to be absorbed by the flexible shin cushion 88.

The invention claimed is:

1. A knee pad assembly adapted to cushion a knee of a workman, while the workman kneels on a work surface, said knee pad assembly comprising:

an upper knee cushion manufactured from a cushion material that is configured to receive thereagainst and cover the knee of the workman;

a lower base located under said upper knee cushion and manufactured from a material that is harder than the cushion material from which said upper knee cushion is manufactured, said lower base having a first and an opposite side and a shoulder located at each of said first and opposite sides, and said lower base being configured to lay on the work surface when the workman kneels on the work surface; and a spring located between said upper knee cushion and said lower base to undergo a compression in response to the workman's knee pressing down on the upper knee cushion towards said lower base when the workman kneels on the work surface and his knee is received against said upper knee cushion, said spring including at least one spring sheet manufactured from a flexible material having a spring memory, said spring sheet lying on and being supported by the shoulders at the first and opposite sides of said lower base so as to extend laterally across said lower base between the shoulders thereof such that said upper knee cushion lays on said spring sheet so as to suspend the workman's knee above the work surface, said knee pad assembly further comprising a compression space that is located between said spring sheet and said lower base, said spring sheet on which said upper knee cushion lays being held by said shoulders above said compression space and bending into said compression space such that said upper knee cushion moves towards said lower base in response to the workman's knee pressing down on said upper knee cushion.

2. The knee pad assembly recited in claim 1, wherein said spring sheet is manufactured from a flexible carbon fiber material.

3. The knee pad assembly recited in claim 1, wherein said spring also includes a second spring sheet that is manufactured from a flexible material having a spring memory, said first and said second spring sheets extending laterally across said lower base between the shoulders thereof to lie above said compression space such that said upper knee cushion lays on said first and second spring sheets so as to suspend the workman's knee above the work surface.

4. The knee pad assembly recited in claim 3, wherein said first and second spring sheets are spaced one behind the other along a longitudinal axis of said lower base so as to flex independently of one another in response to the workman's knee pressing down on the upper knee cushion towards said lower base.

5. The knee pad assembly recited in claim 1, wherein said lower base has a front, a rear, a longitudinal axis that runs between the front and the rear, and a bottom surface that is continuously curved along said longitudinal axis.

6. The knee pad assembly recited in claim 1, wherein said lower base has a U-shaped cavity within which said compression space is located to receive said upper knee cushion and said spring sheet on which said upper knee cushion lays, said upper knee cushion being compressed against said spring sheet in response to the workman's knee pressing down on the upper knee cushion to push said upper knee cushion and said spring sheet into the compression zone of the U-shaped cavity of said lower base and thereby prevent the knee of the workman from sliding off said upper knee cushion when the workman rocks back and forth on the work surface and said lower base lies on the work surface.

7. The knee pad assembly recited in claim 1, further comprising a knee pad strap connected to said lower base and having a size that is sufficient to surround a leg of the workman and hold said upper knee cushion above said lower base against the workman's knee.

8. The knee pad assembly recited in claim 1, further comprising a scuff guard lying below and attached to said lower base to prevent scuffing of the work surface caused by said lower base when said lower base lies on the work surface and the workman rocks back and forth on the work surface.

9. The knee pad assembly recited in claim 1, further comprising a shin support having a top and a bottom and being attached to and extending from said lower base, said shin support also having a shin cushion located at the top thereof to receive a shin of the workman thereagainst when said upper knee cushion covers the knee of the workman.

10. The knee pad assembly recited in claim 9, wherein said shin support also has a round pivot located at the bottom thereof, said shin support rotating at said round pivot downwardly towards and upwardly away from the work surface when the lower base lies on the work surface and the workman rocks back and forth on the work surface.

11. The knee pad assembly recited in claim 9, wherein said shin support is detachably connected to said lower base so as to extend outwardly therefrom, the top of said shin support having at least one coupling tab standing upwardly therefrom and said lower base having at least one coupling slot formed therein within said one coupling tab is removably received.

12. The knee pad assembly recited in claim 5, wherein the continuously curved bottom surface of said lower base is configured to have a size that extends from the knee of the workman to the shin of the workman.

13. The knee pad assembly recited in claim 1, wherein said spring sheet is fixedly attached to the shoulders located at the first and opposite sides of said lower base such that said spring sheet bends into said compression space and moves with said upper knee cushion towards said lower base in response the workman's knee pressing down on said upper knee cushion.

14. The knee pad assembly recited in claim 1, wherein the compression space located between said spring sheet and said lower base is an empty space having an initial size, the initial size of said empty space being reduced when the spring sheet on which said upper knee cushion lays bends into said compression space and moves with said upper knee cushion towards said lower base.

* * * * *